US006402376B1

(12) United States Patent
Bois

(10) Patent No.: US 6,402,376 B1
(45) Date of Patent: Jun. 11, 2002

(54) BAG COMPRISING SLIDE-ACTUATED CLOSING PROFILES

(75) Inventor: Henri Georges Bois, Neuilly sur Seine (FR)

(73) Assignee: Flexico-France, Henonville (FR)

( * ) Notice: Subject to any disclaimer, the term of this patent is extended or adjusted under 35 U.S.C. 154(b) by 0 days.

(21) Appl. No.: 09/719,557

(22) PCT Filed: Apr. 25, 2000

(86) PCT No.: PCT/FR00/01082

§ 371 (c)(1),
(2), (4) Date: Dec. 27, 2000

(87) PCT Pub. No.: WO00/64765

PCT Pub. Date: Nov. 2, 2000

(30) Foreign Application Priority Data

Apr. 27, 1999 (FR) ..... 99 05303

(51) Int. Cl.[7] ..... B65D 33/25

(52) U.S. Cl. ..... 383/64; 383/61; 383/66; 383/203

(58) Field of Search ..... 383/61, 63, 64, 383/66, 203, 204

(56) References Cited

U.S. PATENT DOCUMENTS 4,335,817 A * 6/1982 Bahr ..... 383/66 X
5,036,643 A * 8/1991 Bodolay ..... 383/61 X
5,660,479 A * 8/1997 Nay et al. ..... 383/61 X
5,672,009 A 9/1997 Malin
5,713,669 A 2/1998 Thomas et al.
5,806,984 A * 9/1998 Yeager ..... 383/61 X
5,951,453 A * 9/1999 Yeager ..... 383/63 X
5,954,433 A * 9/1999 Yeager ..... 383/63 X
6,116,314 A * 9/2000 Johnson ..... 383/66 X
6,264,366 B1 * 7/2001 Custer ..... 383/64 X

FOREIGN PATENT DOCUMENTS

| | | |
|---|---|---|
| EP | 0 051 010 | 5/1982 |
| EP | 0 102 301 | 3/1984 |
| EP | 0 479 661 | 4/1992 |
| EP | 0 528 721 | 2/1993 |
| FR | 2 778 362 | 11/1999 |
| FR | 2 780 039 | 12/1999 |
| FR | 2 785 259 | 5/2000 |
| WO | 97/06062 | 2/1997 |
| WO | 98/45180 | 10/1998 |

* cited by examiner

*Primary Examiner*—Jes F. Pascua
(74) *Attorney, Agent, or Firm*—Jacobson Holman, PLLC

(57) ABSTRACT

A bag which includes additional closing profiles which are respectively actuated by a slide during opening and closing. The bag includes a wall portion which forms a veil which can be broken and which is designed in such a way that it covers the slide before the bag is used.

5 Claims, 1 Drawing Sheet

100
17a
17
16
17b
110
L1
11
30
L2
40
32
20
L3
24
22
10
13
14
12
19

17
16
17a
17b
11
10
32
40
30
14
20
22
13
12

17a
16
100
17b
100
30
40
10
14
20
32a
32b
33
22
13
12

BAG COMPRISING SLIDE-ACTUATED CLOSING PROFILES

FIELD OF THE INVENTION

The present invention relates to the field of bags having complementary closure strips actuated both in opening and in closing by a slide.

BACKGROUND OF THE INVENTION

Such bags are described, for example, in documents EP-A-0 051 010, EP-A-0 102 301, and EP-A-0 479 661.

Such bags that are opened and closed by a slide have already given good service.

The slides make it easier to open and close the bags. The presence of a slide is particularly appreciated by the elderly or the visually handicapped.

Nevertheless, in spite of their advantages, bags with slides are not at present as widespread as expected.

The object of the present invention is to improve this field.

SUMMARY OF THE INVENTION

This object is achieved in the context of the present invention by a bag including complementary closure strips actuated both for opening and for closing by a slide, the bag being characterized by the fact that it includes a portion of the bag wall that forms a web that is suitable for being broken and that is designed to cover the slide before the bag is used.

As will be understood on reading the description below, the present invention thus uses simple means to prevent access to the slide so long as the covering web is in place.

This avoids any manipulation, whether accidental, innocent, or with criminal intent, particularly on the shelves of large stores.

BRIEF DESCRIPTION OF THE DRAWINGS

Other characteristics, objects, and advantages of the present invention will appear on reading the following detailed description with reference to the accompanying drawing, given by way of non-limiting example and in which.

DETAILED DESCRIPTION OF THE PREFERRED EMBODIMENTS

Figures 1, 2, 3:
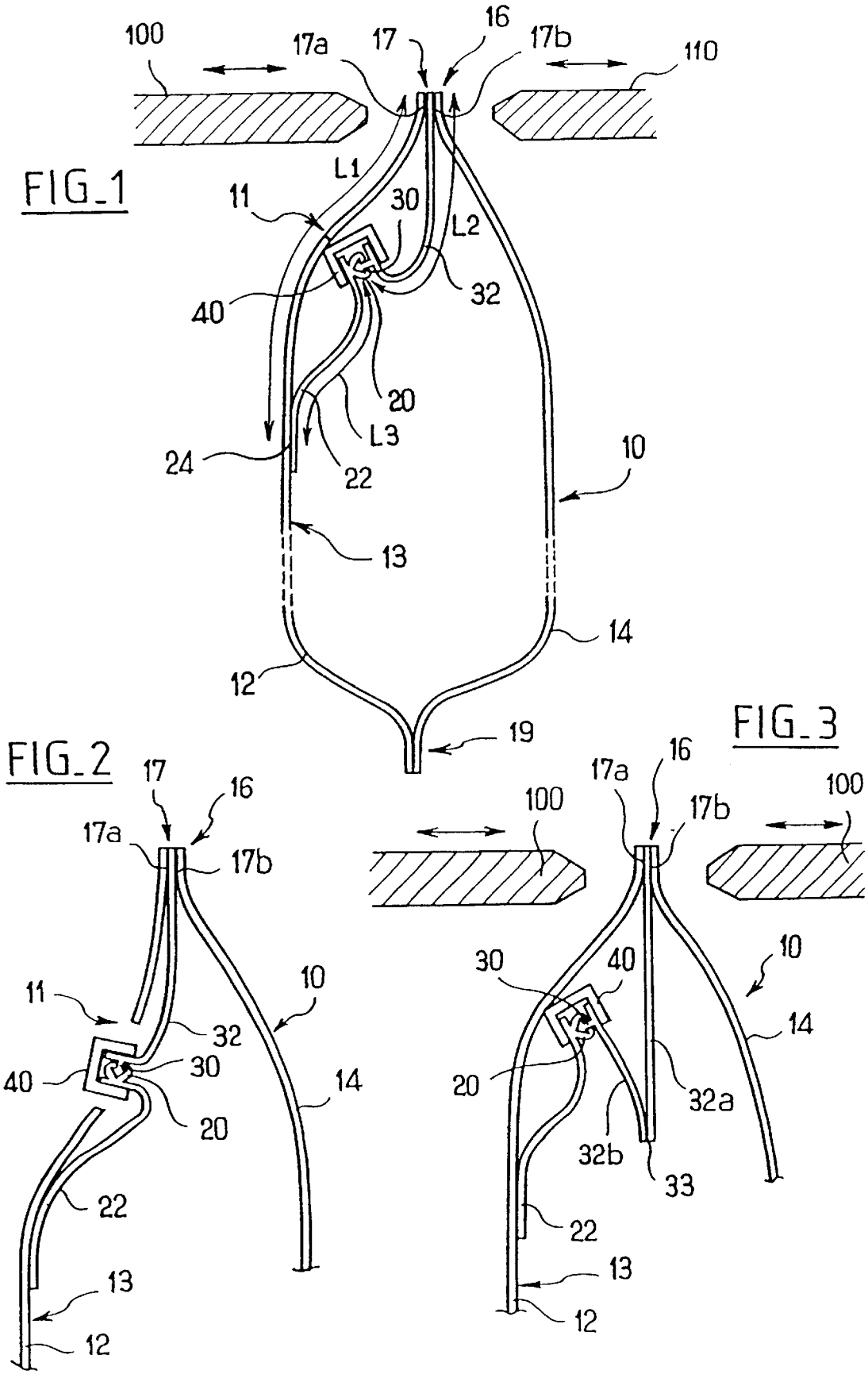
FIG. 1 is a section view through a bag of the invention, during a step of fixing part of the closure strips to the walls of the bag.
FIG. 2 is a section view through the same bag, after it has been opened.
FIG. 3 is a view similar to FIG. 1 showing a bag constituting a variant embodiment of the present invention.

FIG. 1 shows a bag 10 made up of two parallel walls 12, 14 defining a bag mouth 16.

The general structure of such a bag can be made by numerous dispositions known to the person skilled in the art.

Thus, for example, the two walls 12, 14 of the bag can be made from a common sheet which is folded in half so as to form two generally parallel flaps corresponding to said walls 12, 14 which are fixed together around three sides of their periphery, e.g. by adhesive or by heat-sealing.

Under such circumstances, the mouth 16, which preferably corresponds to a zone in which the two walls 12, 14 are joined by adhesive or heat-sealing, can be parallel to and opposite from the fold line in the sheet, or it can be perpendicular to said fold line (in which case the bottom 19 of the bag is likewise formed by sticking or heat-sealing together the two flaps 12, 14, as shown in non-limiting manner in FIG. 1).

In a variant, the two walls 12, 14 can be made from two initially separate sheets that are generally parallel to each other and fixed together around their periphery over four sides, e.g. by adhesive or by heat-sealing, as mentioned above.

Bags of the present invention are fixed with complementary closure strips 20, 30 that are actuated by a slide 40.

These means can be embodied in numerous ways that are known in themselves.

Thus, for example, the complementary closure strips 20, 30 can be made respectively of complementary male/female type structures or they can be made of structures comprising complementary hooks.

The person skilled in the art knows numerous shapes for complementary closure strips as described in the literature and/or as on sale at present. That is why the shapes of the closure strips 20, 30 are not described in greater detail below.

The same applies to the slide 40.

It too can be embodied in numerous different ways.

In particular, the slide 40 can comply with the dispositions described in document EP-A-0 479 661.

That is why the slide 40 is not described in detail below.

Nevertheless, it should be observed that the slide 40 is preferably made of plastics material and comprises two side flanges interconnected via a base and co-operating with an elongate central tongue to define two converging passages for the mutually-engageable complementary closure strips 20, 30. Thus, when the travel direction of the slide 40 relative to the closure strip 20, 30 tends to move the slide 40 so as to force the closure strips 20, 30 into engagement, the bag is closed. When the slide 40 is moved in the opposite direction, the bag is opened.

The film(s) constituting the walls 12, 14 of the bag can be embodied in numerous ways; The film is preferably made of a plastics material, very preferably of poly-olefin, most advantageously of low or high density poly-ethylene or indeed polypropylene. Nevertheless, the invention is not limited to these particular materials.

The invention also applies to bags made of composite material, for example a sheet based on plastic- or metal-coated paper, etc. . . .

The complementary strips 20, 30 are carried by respective support webs 22, 32 fixed to the walls of the bag as described below.

In the embodiment shown in accompanying FIG. 1, a first one of the support webs 22 is fixed to the inside surface 13 of a wall 12 at a distance from the line of heat-sealing 17 defining the mouth 16. In FIG. 1, the connection zone between the support web 22 and the wall 12 is given overall reference 24. This connection zone can be defined by adhesive or heat-sealing between the inside surface 13 of the wall 12 and the support web 22. Where appropriate, and as is known to the person skilled in the art, this connection zone 24 can be defined, for example, by heat-sealing ribs that are integrally extruded on the support web 22 and/or the wall 12.

The second support web 32 in the embodiment shown in FIG. 1 is sandwiched between the two walls 12, 14 at the mouth 16, and it is fixed to them at the connection 17.

More precisely, a connection 17*a* is defined between a first face of the support web 32 and the wall 12, and a second connection 17*b* is defined between the second face of the support web 32 and the second wall 14.

It will be observed, and this constitutes an important advantage of the invention, that the connection defined in this way between the support web 32 and the walls 12, 14 can be implemented using conventional heat-sealing jaws of the kind commonly used for closing a bag at its mouth by connecting together the walls 12 and 14 of the bag directly in the conventional manner. Such heat-sealing jaws are referenced 100 and 110 in FIG. 1.

The person skilled in the art will readily understand that the wall portion 12 situated between the connections 24 and 17*a* thus originally covers the slide 40 so as to prevent direct access thereto.

However, once this portion of the wall 12 has been broken, the user has free access in conventional manner to the slide 40 both for opening and for closing the bag by separating or interfitting the strips 20, 30.

For this purpose, the above-specified portion of the wall 12 can be provided with a line of weakness 11 which extends parallel to the connections 24, 17*a* so as to make this portion of the wall easier to open.

Furthermore, as shown diagrammatically in FIG. 1, it is preferable for the length L1 of the above-specified portion of the wall 12 situated between the connection zones 24 and 17*a*, i.e. the distance L1 between the connection zones 24 and 17*a* when the portion of the wall 12 between them is under tension, to be less than the sum of the corresponding lengths L2 and L3 of the support webs 22 and 32 situated between the connection zones 24 and 17*a*. The person skilled in the art will understand that complying with this geometrical condition facilitates access to the slide 40 and to the strips 20, 30 through the opening 11 formed in the portion of the wall 12 situated between the connection zones 24 and 17*a* after said wall portion has been broken.

This access is shown diagrammatically in FIG. 2.

The bags shown in FIG. 1 are preferably made on a form, fill, and seal (FFS) type machine, i.e. a machine for performing automatically the operations of forming bags, filling them, and closing them. The general structure of such conventional machines is not described in detail below.

Nevertheless, it is recalled that FFS machines generally comprise a forming throat which receives as input the film in the flat state coming from a reel, and which outputs the film shaped into a tube, a filling chute which opens out into the forming neck and consequently into said tube, means for feeding closure strips and for fixing them to the film, longitudinal heat-sealing means for closing the tubes longitudinally, and means suitable for operating sequentially to generate a first transverse line of heat-sealing before content is inserted into the tube via the filling chute, and then a second transverse line of heat-sealing once the content has been inserted into the tube, so as to close a package around the content.

In this context of an FFS machine, in the present invention, the support webs 22, 32 carrying the closure strips 20, 30 and the slide 40 are preferably brought to the film transversely to its travel direction and upstream from the forming neck. More precisely, in this embodiment, the support web 22 is fixed to the film 12 in the connection zone 24 using appropriate means, and in particular heat-sealing jaws, upstream from the forming neck, while the second support web 32 is fixed to the walls 12 and 14 in the connection zone 17 by means of the heat-sealing jaws 100, 110 when the above-mentioned "second" line of transverse heat-sealing is made.

Nevertheless, the invention is not limited to having the support webs 22, 32 disposed transversely to the direction in which the film advances. The invention can equally be applied to feeding the support webs 22, 32 together with the closure strips 20, 30 and the associated slide 40 longitudinally, i.e. parallel to the direction in which the above-mentioned film advances. Under such circumstances, the support webs 22, 32 are fixed on the walls 12, 14 not by means of transverse heat-sealing jaws, but by means of longitudinal jaws, i.e. jaws situated parallel to the direction of the forming neck, e.g. the conventional jaws used for longitudinally closing the tube that is obtained at the outlet from the forming neck.

It will be observed that in the event of the support webs 22, 32 being placed longitudinally, the two connection zones 17, 24 can be made simultaneously and not successively as described above when they were put into place transversely respectively upstream and downstream from the forming neck.

FIG. 3 shows a variant embodiment in which one of the support webs (in this case referenced 32 and situated adjacent to the mouth 16) is itself made up of two segments 32*a*, 32*b*, with one of the segments 32*a* situated adjacent to the mouth 16 and fixed to the walls 12, 14 in zones 17*a*, 17*b* as described above, while the other segment 32*b* is situated adjacent to the strip 30, and with the two segments 32*a*, 32*b* forming a dihedral whose concave side is directed towards the outside, i.e. towards the wall 12. Under such circumstances, the two segments 32*a*, 32*b* can be constituted by elements that are initially separate and that are connected together by adhesive or by heat-sealing at the ridge 33 of the above-specified dihedral or can indeed be constituted by a single element that is folded onto itself via a sharp angle at said ridge 33.

The person skilled in the art will also understand that by using a portion of wall so that it initially covers the slide it is possible to solve in simple manner problems associated with sealing that are generally encountered in bags fitted with slide-actuated closure strips. Naturally, to ensure that bags are sealed sufficiently after the wall 12 has been broken, and after the slide 40 has been manipulated, i.e. after the bag has been opened, the support webs 22, 32 and/or the closure strips 20, 30 and/or the slide can be provided with numerous dispositions for providing sealing, and in particular those defined by the Applicant in French patent applications FR 98/16236, FR 98/13732, FR 98/13734, and FR 98/05681.

Naturally, to ensure that the bag is sealed, it is necessary for the end zones of the support webs 22, 32 extending transversely to the connection zones 24, 17 also to be sandwiched between the side edges of the walls 12, 14 and fixed thereto.

Naturally, the present invention is not restricted to the particular embodiments described above, but extends to any variants within the spirit of the invention.

What is claimed is:

1. A bag comprising complementary closing strips actuated both for opening and for closing by a slide, the bag including a portion of the bag wall that forms a web that is suitable for being broken and that is designed to cover the slide before the bag is used, the closure strips being carried by respective support webs, one of which is fixed to the inside surface of a wall of the bag at a distance from a mouth thereof, and the other of which is fixed to at least one wall of the bag at the mouth, said other support web being made up of two segments, one segment adjacent to the mouth and the other adjacent to the strip, the segments constituting a dihedral whose concave side is directed towards the outside of the bag, and towards the web that can be broken and that initially covers the slide.

2. The bag according to claim 1, wherein the other support web is sandwiched at the mouth between two walls of the bag and is fixed to each of them at the mouth.

3. The bag according to claim 1, wherein the length of said portion that can be broken and that covers the slide, as measured between two connection zones for the webs carrying the closure strip, is less than the sum of the lengths of said support webs situated between said connection zones.

4. The bag according to claim 1, wherein the breakable web covering the slide is provided with a line of weakness.

5. The bag according to claim 1, wherein the web that initially covers the slide is constituted by a portion of one of the walls of the bag, while the closure strips are placed on support webs that are fitted to the walls of the bag.

* * * * *